US005671859A

United States Patent [19]

Sheu et al.

[11] Patent Number: 5,671,859

[45] Date of Patent: Sep. 30, 1997

[54] DOOR CONTROL DEVICE FOR A LARGE GARBAGE CONTAINER

[76] Inventors: Miin-Tsang Sheu, No. 156, Cheng Kung Road, Chang Hua City, Taiwan; Shang-Jen Chang, No. 204, Nan Chang Road, Tou Nan Chen, Yun Lin Hsien, Taiwan

[21] Appl. No.: 595,281

[22] Filed: Feb. 1, 1996

[51] Int. Cl.[6] ..... B65D 43/26

[52] U.S. Cl. ..... 220/263; 230/264

[58] Field of Search ..... 220/262, 263, 220/264

[56] References Cited

U.S. PATENT DOCUMENTS

| | | | |
|---|---|---|---|
| 1,135,810 | 4/1915 | Jones | 220/263 |
| 1,263,591 | 4/1918 | Murphy | 220/263 |
| 1,754,802 | 4/1930 | Raster | 220/263 |
| 4,625,888 | 12/1986 | Thompson | 220/264 |
| 4,655,357 | 4/1987 | Hampton, Jr. | 220/264 |

*Primary Examiner*—Joseph M. Moy

*Attorney, Agent, or Firm*—Beveridge, Degrandi, Weilacher & Young LLP

[57] ABSTRACT

A garbage container has a sleeve, a reel support, the first wheel support, the second wheel support, an elongated rod, and a door. A bottom seat is beneath the container. A pedal device is in front of the bottom seat. The pedal device has a pedal seat, a vertical plate, a positioning plate and a pedal plate. The vertical plate has an interior to receive the positioning plate. The vertical plate is positioned on the front of the bottom seat. The positioning plate is positioned in the vertical plate pivotally. The first reel is disposed in an upper portion of the positioning plate pivotally. The second reel is disposed in the reel support pivotally. A first and second driving wheels are disposed in the corresponding wheel supports, respectively. Each of the first and second driving wheels has a large wheel juxtapose to a small wheel.

1 Claim, 7 Drawing Sheets

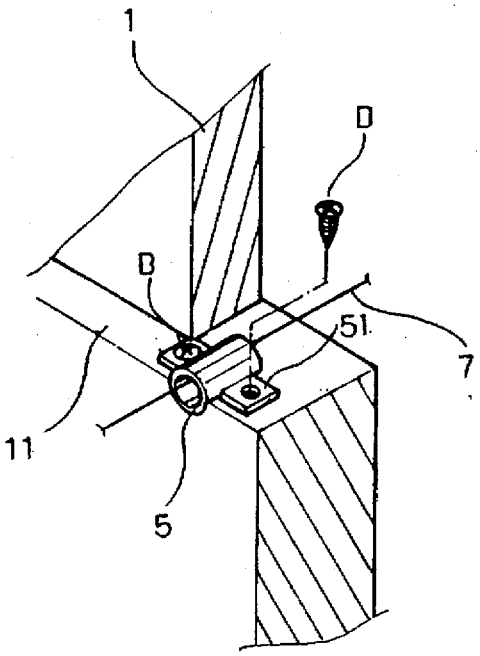
FIG 1-B
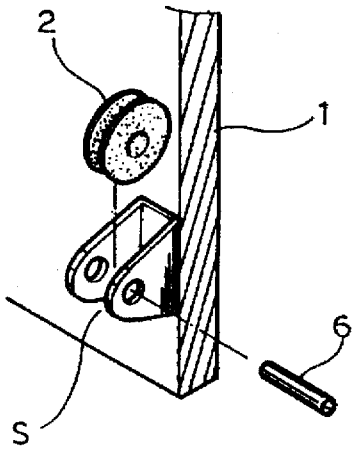
FIG 1-C
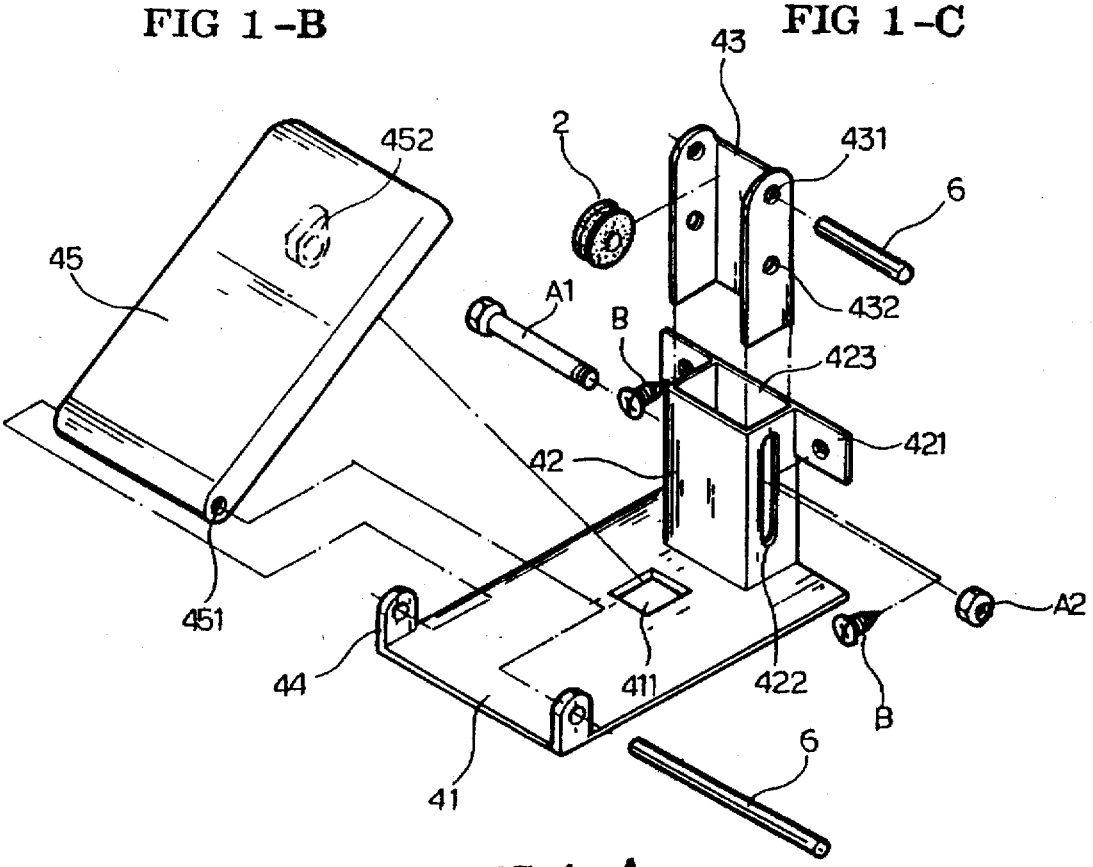
FIG 1-A

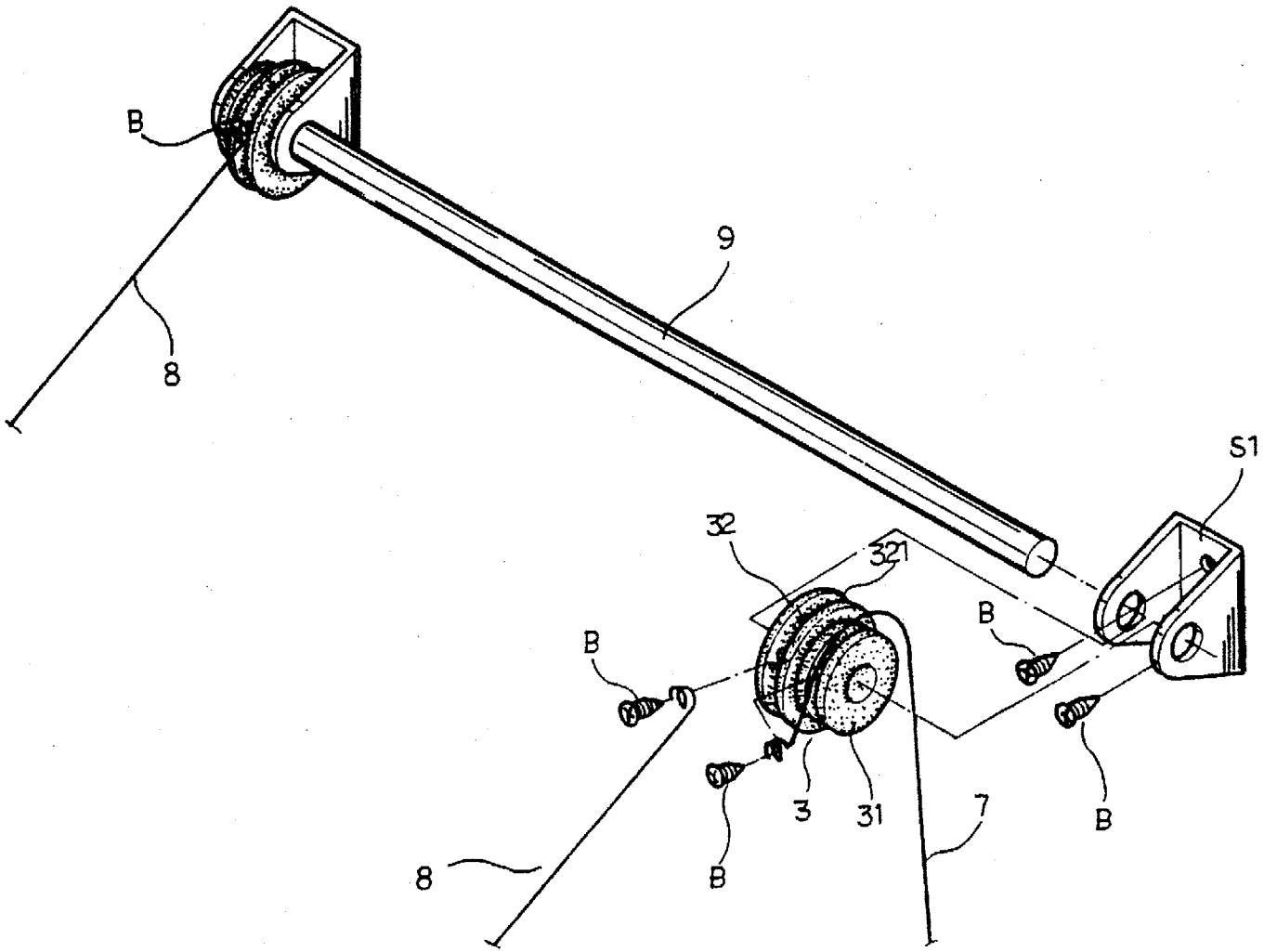
FIG 1-D

DOOR CONTROL DEVICE FOR A LARGE GARBAGE CONTAINER

BACKGROUND OF THE INVENTION

The invention relates to a door control device for a large garbage container. More particularly, the invention relates to a door control device which is operated pedally.

The conventional cover of a large garbage container should be opened by hand. However, the cover is always dirty so that it is not very convenient to open the cover with hand. The user may use a garbage bag to open the cover, so the cover becomes very dirty and unsanitary. An improved cover can be opened electrically. However, the cost of the electricity is very expensive. The electrically operated covers should be often checked or repaired. When the electrically operated cover is broken down, the cover should be opened by hand again. Thus the above-mentioned problem will occur. Some garbage containers are located far from a house, so it is very difficult to install electrically operated covers for these large garbage containers.

SUMMARY OF THE INVENTION

An object of the invention is to provide a door control device for a large garbage container in order to operate the door control device pedally.

Another object of the invention is to provide a door control device for a large garbage container in order to open the door smoothly.

Another object of the invention is to provide a door control device for a large garbage container in order to adjust the angle of the door while the door is opened.

Accordingly, a garbage container comprises a sleeve positioned at the front right lower corner of the container, a reel support disposed in the rear right lower corner of the container, the first wheel support disposed in the rear right upper corner of the container, the second wheel support disposed in the rear left upper corner of the container, an elongated rod connecting the wheel supports, and a door disposed on the front upper portion of the container. A bottom seat is disposed beneath the container. A pedal device is disposed in front of the bottom seat. The pedal device has a pedal seat, a hollow vertical plate with two slots thereon, a positioning plate, and a pedal plate connected to the pedal seat pivotally. The vertical plate which is disposed on the pedal seat vertically has an interior to receive the positioning plate. The vertical plate is positioned on the front surface of the bottom seat. The pedal plate has a rope positioning block thereunder. The positioning plate is positioned in the vertical plate pivotally. The first reel is disposed in an upper portion of the positioning plate pivotally. The second reel is disposed in the reel support pivotally. A first and second driving wheels are disposed in the corresponding wheel supports, respectively. Each of the first and second driving wheels has a large wheel juxtapose to a small wheel. An end of a driving rope is connected to the rope positioning block. The driving rope passes through the first reel, inserts in the sleeve, passes through the second reel, and winds the small wheel of the first driving wheel. The first follower rope extends from the door to the large wheel of the first driving wheel. The second follower rope extends from the door to the large wheel of the second driving wheel.

BRIEF DESCRIPTION OF THE DRAWINGS

FIG. 1A is a perspective exploded view of a pedal device;

FIG. 1B is a perspective view of a sleeve and two positioning fins;

FIG. 1C is a perspective exploded view of a reel and a reel support;

FIG. 1D is a partially perspective exploded view of a driving rope, a follower rope, a driving wheel and a wheel support;

DETAILED DESCRIPTION OF THE INVENTION

Figure 2:
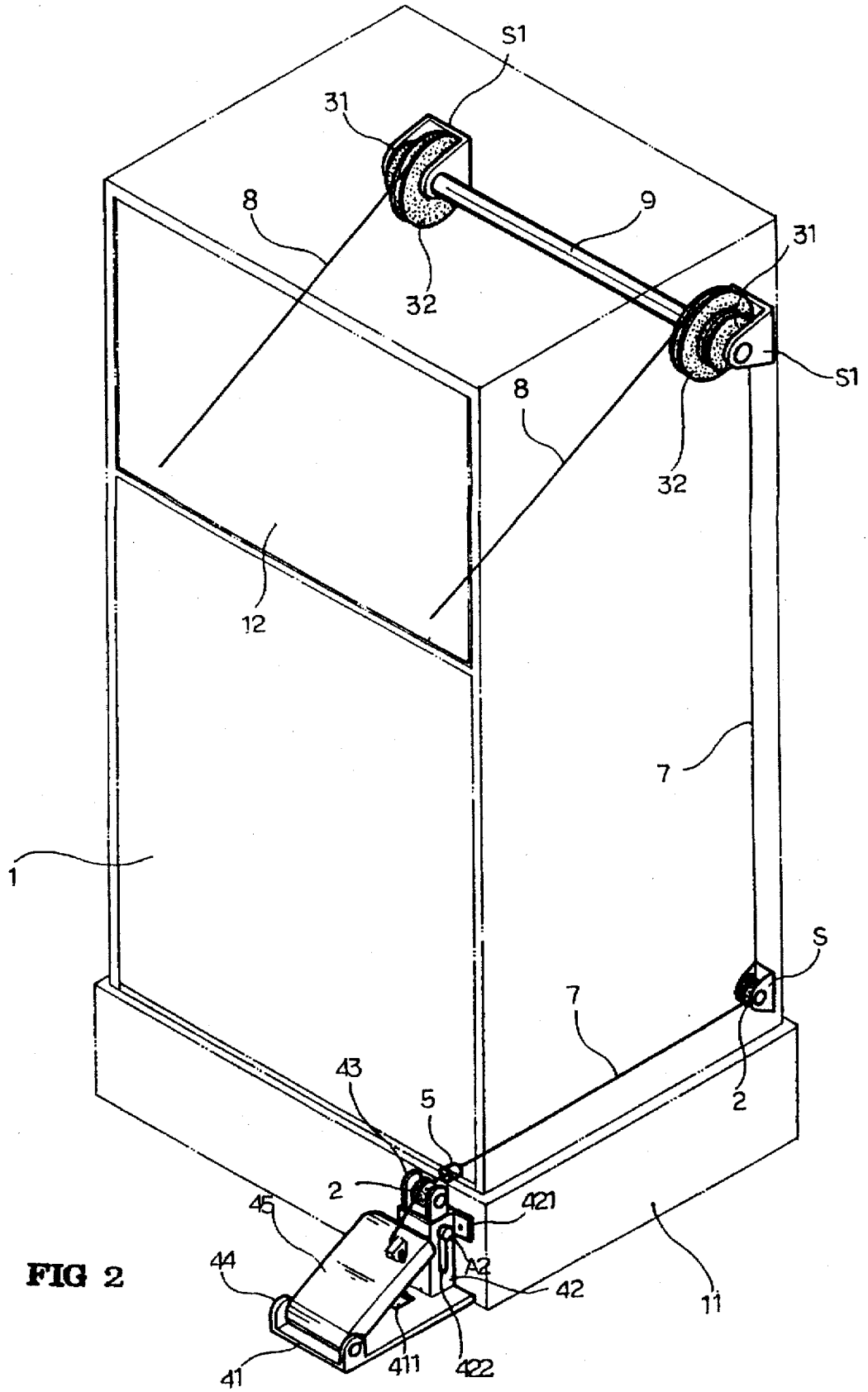
FIG. 2 is a perspective assembly view of a large garbage container.

Referring to FIGS. 1A, 1B, 1C, 1D and 2, a garbage container 1 has a sleeve 5 which is disposed at the front right lower corner of the container 1 to communicate with the interior and exterior of the container 1, a reel support S disposed in the rear right lower corner of the container 1, the first wheel support S1 disposed in the rear right upper corner of the container 1, the second wheel support S1 disposed in the rear left upper corner of the container 1, an elongated rod 9 connecting the wheel supports S1, and a door 12 disposed on the front upper portion of the container 1. A bottom seat 11 is disposed beneath the container 1. A pedal device 4 is disposed in front of the bottom seat 11.

Figure 3:
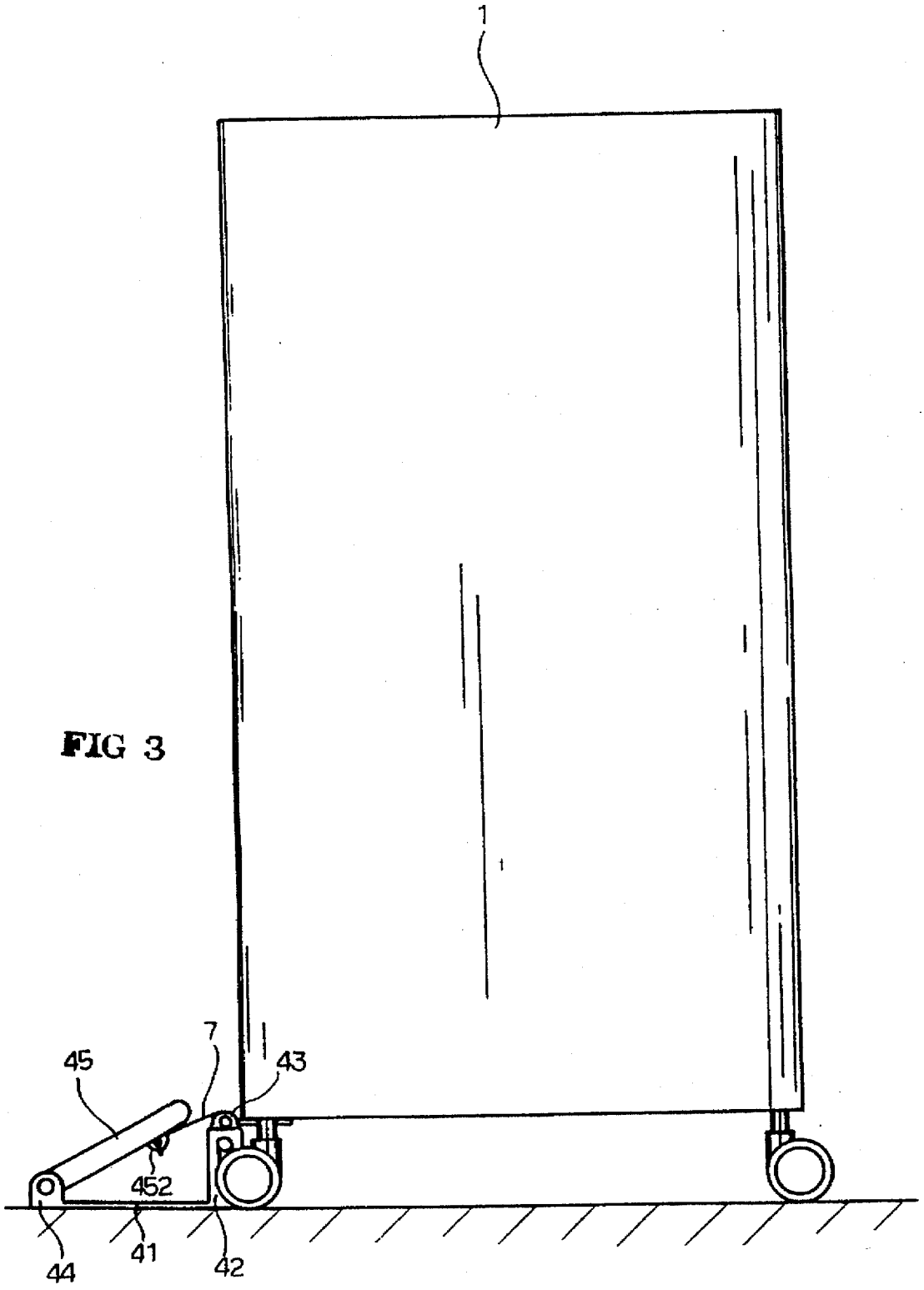
FIG. 3 is a side elevational view of a large garbage container.
Figure 4:
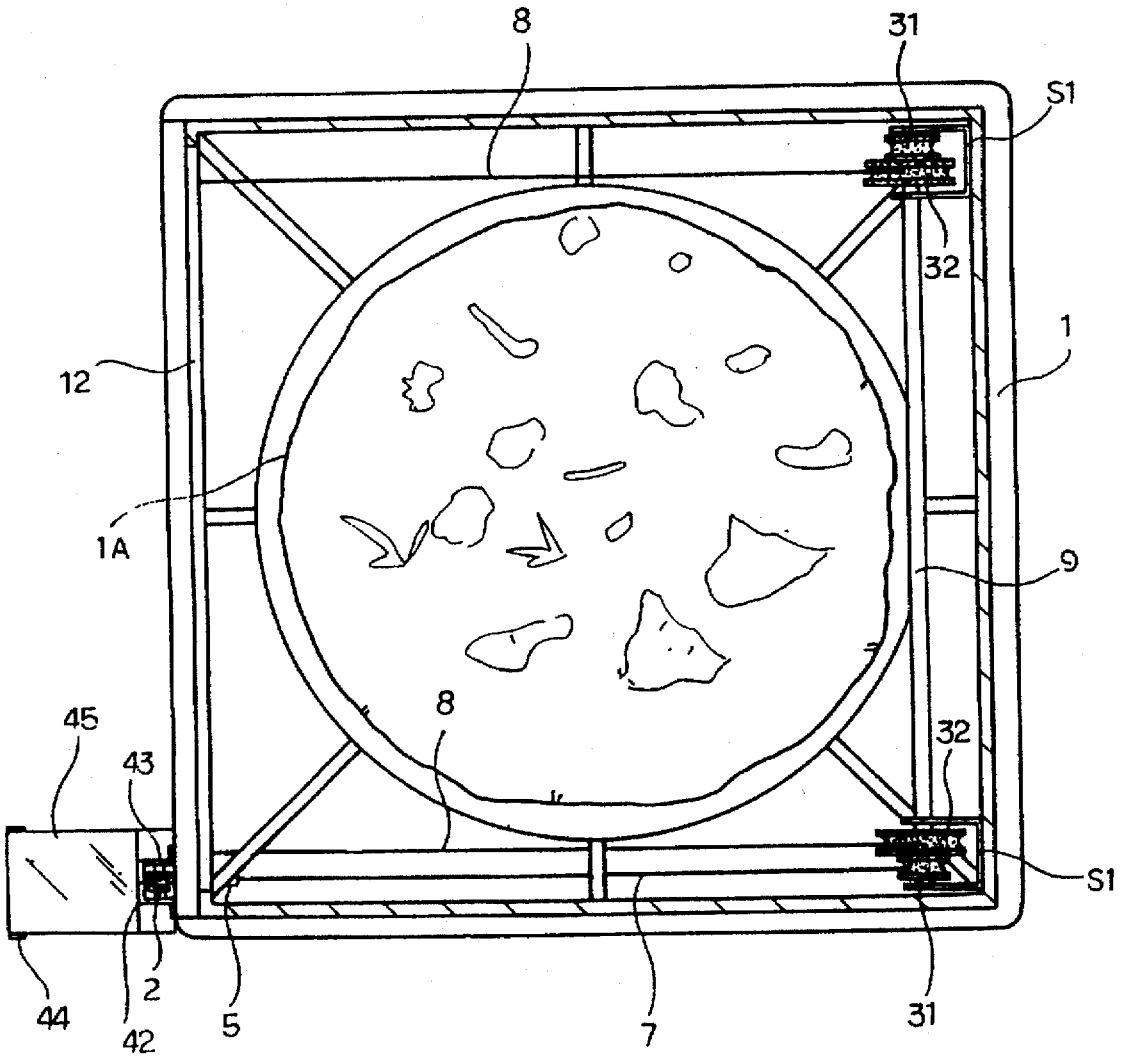
FIG. 4 is a top plan view of a large garbage container.

Referring to FIGS. 1A, 1B, 1C, 1D and 2 to 4, the pedal device 4 has a pedal seat 41 with a square hole 411 thereon, a hollow vertical plate 42 with two opposite slots 422 thereon, a positioning plate 43, and a pedal plate 45. The vertical plate 42 which is disposed on the pedal seat 41 vertically has an interior 423 to receive the positioning plate 43. Two positioning lugs 421 which are disposed at two sides of the vertical plate 42 are positioned on the front surface of the bottom seat 11. Two lobes 44 protrude upward at the front end of the pedal seat 41. The pedal plate 45 which has a rope positioning block 452 thereunder is disposed between the lobes 44. The pedal plate 45 has a through hole 451 to receive a pivot pin 6 pivotally. The positioning plate 43 has two opposite pivot holes 431 and two opposite positioning holes 432. The positioning plate 43 is positioned in the vertical plate 42 with a bolt A1 and a nut A2. The first reel 2 is disposed in an upper portion of the positioning plate 43 pivotally. The first reel 2 has a central groove 21. The sleeve 5 has two positioning fins 51 which are positioned on the bottom seat 11 with two screws D. The second reel 2 is disposed in the reel support S pivotally. A first and second driving wheels 3 are disposed in the corresponding wheel supports S1, respectively. Each of the first and second driving wheels 3 has a large wheel 32 juxtapose to a small wheel 31. An end of a driving rope 7 is connected to the rope positioning block 452. The driving rope 7 passes through the first reel 2, inserts in the sleeve 5, passes through the second reel 2, and winds the small wheel 31 of the first driving wheel 3. The first follower rope 8 extends from the door 12 to the large wheel 32 of the first driving wheel 3. The second follower rope 8 extends from the door 12 to the large wheel 32 of the second driving wheel 3.

Figure 5:
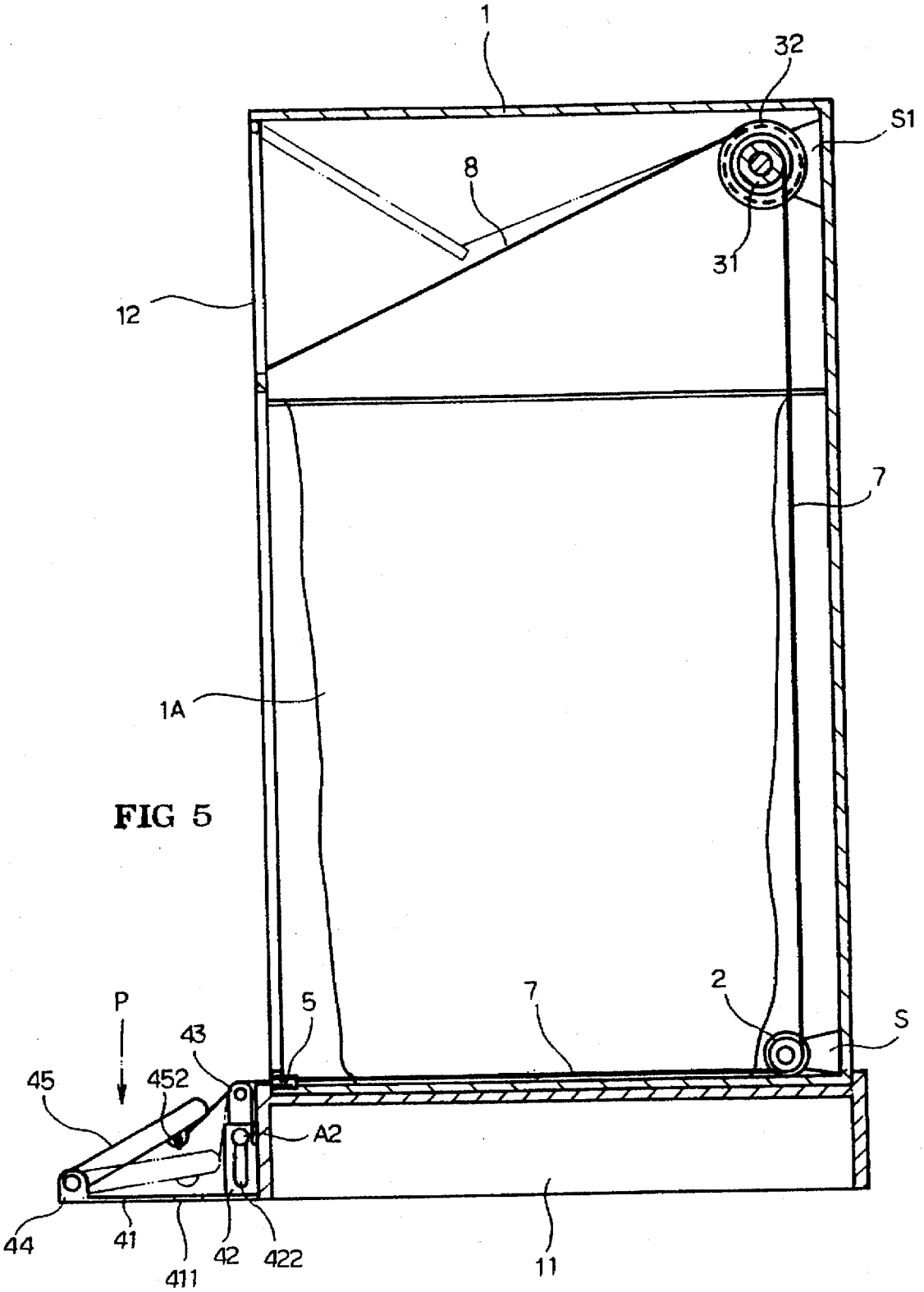
FIGS. 5 and 6 are schematic views illustrating the operation of a large garbage container.
Figure 6:
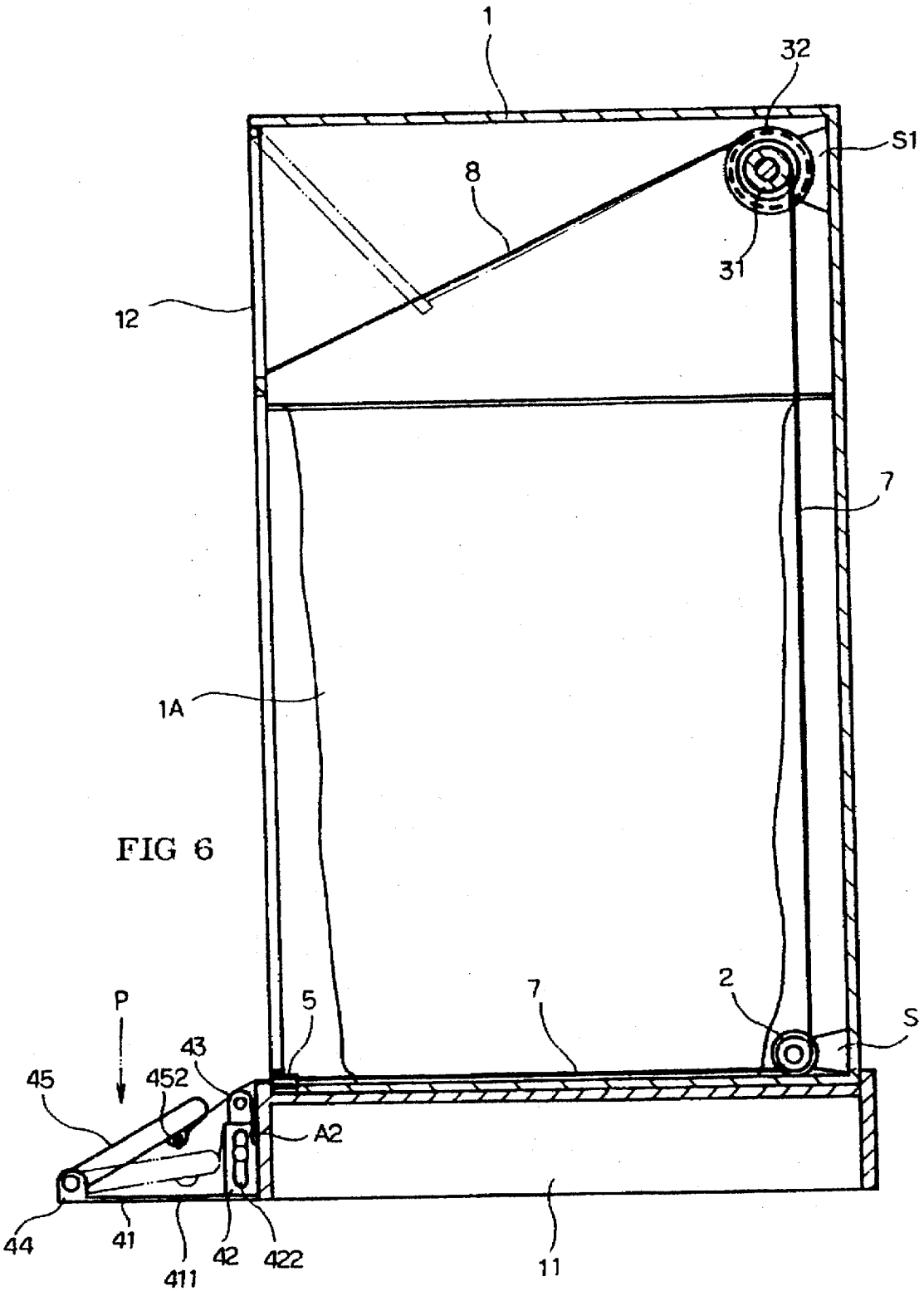

Referring to FIGS. 2 to 6, a garbage bag 1A is confined in the garbage container 1. When the pedal plate 45 is pressed down, the door 12 will be opened. When the pedal plate 45 is pressed down to the utmost, the door 12 will be fully opened.

The invention is not limited to the above embodiment but various modification thereof may be made. Further, various changes in form and detail may be made without departing from the scope of the invention.

I claim:

1. A garbage container comprising:

a sleeve positioned at a front right lower corner of said container, a reel support disposed in a rear right lower corner of said container, a first wheel support disposed in a rear right upper corner of said container, a second wheel support disposed in a rear left upper corner of said container, an elongated rod connecting said wheel supports, a door disposed on a front upper portion of said container, a bottom seat disposed beneath said container, a pedal device disposed in front of said bottom seat, said pedal device having a pedal seat, a hollow vertical plate with two slots thereon, a positioning plate, and a pedal plate connected to said pedal seat pivotally, said vertical plate which is disposed on said pedal seat vertically having an interior to receive said positioning plate, said vertical plate positioned on a front surface of said bottom seat, said pedal plate having a rope positioning block thereunder, said positioning plate positioned in said vertical plate pivotally, said first reel disposed in an upper portion of said positioning plate pivotally, said second reel disposed in said reel support pivotally, a first and second driving wheels disposed in said corresponding wheel supports, respectively, each of said first and second driving wheels having a large wheel juxtapose to a small wheel, an end of a driving rope connected to said rope positioning block, said driving rope passing through said first reel, inserting in said sleeve, passing through said second reel, and winding said small wheel of said first driving wheel, a first follower rope extending from said door to said large wheel of said first driving wheel, and a second follower rope extending from said door to said large wheel of said second driving wheel.

* * * * *